US009638123B2

(12) United States Patent
Ukawa et al.

(10) Patent No.: US 9,638,123 B2
(45) Date of Patent: May 2, 2017

(54) INTERNAL COMBUSTION ENGINE CONTROLLER

(71) Applicant: TOYOTA JIDOSHA KABUSHIKI KAISHA, Toyota-shi (JP)

(72) Inventors: Yoshitaka Ukawa, Toki (JP); Naoto Kato, Toyota (JP); Shigehiro Sugihira, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 20 days.

(21) Appl. No.: 14/765,966

(22) PCT Filed: Sep. 27, 2013

(86) PCT No.: PCT/JP2013/076268
§ 371 (c)(1),
(2) Date: Aug. 5, 2015

(87) PCT Pub. No.: WO2014/129003
PCT Pub. Date: Aug. 28, 2014

(65) Prior Publication Data

US 2015/0377163 A1 Dec. 31, 2015

(30) Foreign Application Priority Data

Feb. 25, 2013 (JP) ..... 2013-034987

(51) Int. Cl.
*F02M 1/00* (2006.01)
*F02D 41/04* (2006.01)
(Continued)

(52) U.S. Cl.
CPC ..... *F02D 41/045* (2013.01); *F02D 11/02* (2013.01); *F02D 11/105* (2013.01);
(Continued)

(58) Field of Classification Search
CPC . F02D 41/0025; F02D 2200/1006; F02P 5/04
(Continued)

(56) References Cited

U.S. PATENT DOCUMENTS 8,010,258 B2 8/2011 Tanaka et al.
8,874,348 B2 10/2014 Ohtsuka et al.
(Continued)

FOREIGN PATENT DOCUMENTS

JP 2008-064001 A 3/2008
JP 2010-053705 A 3/2010
JP 2010-174696 A 8/2010

OTHER PUBLICATIONS

International Search Report issued Oct. 22, 2013, in PCT/JP2013/076268, filed Sep. 27, 2013.

*Primary Examiner* — John Kwon
(74) *Attorney, Agent, or Firm* — Oblon, McClelland, Maier & Neustadt, L.L.P.

(57) ABSTRACT

A controller for an engine controls a throttle opening degree. The controller includes a target opening degree calculating section that selects either a primary request value for a throttle opening degree that corresponds to a torque request or a secondary request value that corresponds to another request and that calculates a target throttle opening degree from the selected one of the first and secondary request values. If the primary request value has been selected, an abnormality occurrence determining section determines whether or not an abnormality has occurred, in accordance with a magnitude of a deviation of the primary request value from the target throttle opening degree. If the secondary request value has been selected, the abnormality occurrence determining section determines whether or not an abnormality has occurred, in accordance with whether or not the
(Continued)

target throttle opening degree is greater than or equal to a predetermined upper limit value.

6 Claims, 6 Drawing Sheets

(51) Int. Cl.

| | |
|---|---|
| ***F02D 41/22*** | (2006.01) |
| ***F02D 11/10*** | (2006.01) |
| ***F02D 37/02*** | (2006.01) |
| ***F02D 41/26*** | (2006.01) |
| ***F02D 11/02*** | (2006.01) |
| *F02D 41/00* | (2006.01) |

(52) U.S. Cl.
CPC ..... *F02D 11/107* (2013.01); *F02D 37/02* (2013.01); *F02D 41/22* (2013.01); *F02D 41/26* (2013.01); *F02D 41/0002* (2013.01)

(58) Field of Classification Search
USPC ..... 123/434, 492, 339.12, 339.16, 339.23, 123/406.23
See application file for complete search history.

(56) References Cited

U.S. PATENT DOCUMENTS

| | | | | |
|---|---|---|---|---|
| 2002/0023793 | A1* | 2/2002 | Hattori | B60T 7/22 180/169 |
| 2004/0002808 | A1* | 1/2004 | Hashimoto | F02D 11/107 701/107 |
| 2005/0103309 | A1* | 5/2005 | Nakagawa | F02D 11/105 123/350 |
| 2008/0312805 | A1* | 12/2008 | Hirata | F02D 19/0605 701/103 |
| 2009/0064967 | A1* | 3/2009 | Shikawa | F02D 13/0226 123/345 |

* cited by examiner

INTERNAL COMBUSTION ENGINE CONTROLLER

TECHNICAL FIELD

The present invention relates in general to internal combustion engine controllers and in particular to those controllers that calculate a target throttle opening degree through request arbitration in relation to various functions of the internal combustion engine.

BACKGROUND ART

So-called torque demand control in the power system of an automobile has been conventionally known that responds to a torque request by collectively controlling more than one actuator, such as a throttle valve and an igniter, of an internal combustion engine. As an example, the torque controller described in Patent Document 1, to increase the engine torque, divides an increment into two sub-increments and determines a request value for throttle opening degree and a request value for ignition timing by taking the respective sub-increments into consideration, so that the target torque is achieved by the sum of the sub-increments through the collective operation of the throttle valve and the igniter.

This example also focuses on differences in response sensitivity of the torque changes achieved through the control of the throttle opening degree and those achieved through the control of the ignition timing. The controller assigns a higher increment distribution priority to a device with a lower response sensitivity.

This controller could produce an excessively large target throttle opening degree due to a computational abnormality, such as a RAM alteration or a RAM value abnormality, resulting in unintended excessive torque generation. That may cause the driver to have a sense of strangeness. Regarding this issue, Patent Document 1, for example in paragraphs 0159 and 0160, describes that whether or not there has occurred an abnormality in the target torque signal generation function is determined based on a difference between a target torque (torque request) and an instruction value that is given to an actuator (throttle valve).

CITATION LIST

Patent Literature

Patent Document 1: Japanese Patent Application Publication, Tokukai, No. 2008-64001

SUMMARY OF THE INVENTION

Problems to be Solved by the Invention

A typical request based on which the throttle opening degree is determined in an internal combustion engine is a torque request specified primarily in accordance with the driver's manual operation of an accelerator pedal. Other common requests used for the same purpose include a startup request, a component protection request, and an OBD (on-board diagnostics) request. For example, even if the driver has depressed the accelerator pedal, air intake may be restricted to prevent an excessive rise in the engine rotational speed, in which case a request is generated to restrict the throttle opening degree to a predetermined value.

If the throttle opening degree is controlled based on such a request, the instruction value given to the throttle motor (i.e., the target throttle opening degree) differs much from the torque request. Therefore, if whether or not there has occurred an abnormality is determined based on a difference between the torque request and the instruction value as in the conventional example, it may be erroneously determined that there has occurred an abnormality.

In view of these problems, it is an object of the present invention to accurately determine whether or not there has occurred a computational abnormality in the control process, for example, when an internal combustion engine controller calculates a target throttle opening degree by taking a torque request and other requests into consideration.

Solution to Problem

The present invention, to achieve the object, switches between abnormality occurrence determining methods depending on whether the target throttle opening degree has been calculated from a torque request or another request.

Specifically, the present invention is directed to an internal combustion engine controller that controls at least a throttle opening degree. The internal combustion engine controller includes: a target opening degree calculating section that selects either a primary request value for a throttle opening degree that corresponds to a torque request for an internal combustion engine or a secondary request value for a throttle opening degree that corresponds to another request and that calculates a target throttle opening degree from the selected one of the first and secondary request values; and an abnormality occurrence determining section that, if the target opening degree calculating section has selected the primary request value, determines whether or not there has occurred an abnormality, in accordance with a magnitude of a deviation of the primary request value from the target throttle opening degree and that, if the target opening degree calculating section has selected the secondary request value, determines whether or not there has occurred an abnormality, in accordance with whether or not the target throttle opening degree is greater than or equal to a predetermined upper limit value.

These invention-identifying features enables the target opening degree calculating section in the controller to select either the primary request value for the throttle opening degree that corresponds to the torque request for the internal combustion engine or the secondary request value that corresponds to another request and to calculate the target throttle opening degree from the selected request value. For example, if the primary request value is selected while the internal combustion engine is running, the throttle opening degree is controlled based on a torque request. The control is performed with excellent drivability.

If the throttle opening degree is controlled based on the primary request value in this manner, the abnormality occurrence determining section can determine whether or not there has occurred an abnormality, in accordance with the magnitude of the deviation of the primary request value from the target throttle opening degree. On the other hand, if one of secondary request values that corresponds to a request other than a torque request, for example, a startup request or an over-rotation prevention request for the internal combustion engine, is selected, the throttle opening degree is controlled based on the selected secondary request value. Therefore, the engine torque has a different magnitude from that of the torque request.

In the latter case, the abnormality occurrence determining section can determine whether or not there has occurred an abnormality, in accordance with whether or not the target throttle opening degree is greater than or equal to a predetermined upper limit value. For example, if the target throttle opening degree is greater than or equal to 15° while the engine is idling, the abnormality occurrence determining section can determine that there has occurred an abnormality. In other words, it can be accurately determined whether or not there has occurred a computational abnormality in the control process when the controller calculates a target throttle opening degree by taking not only the torque request, but also another requests, into consideration.

When the target opening degree calculating section has selected the secondary request value, the abnormality occurrence determining section preferably may reference predetermined information related to a state of the internal combustion engine and determine that there has occurred an abnormality even if the other request is not generated while the internal combustion engine is in the state. This configuration could determine that there has occurred an abnormality even if the target throttle opening degree obtained as a result of a computational abnormality is less than the upper limit value.

Specifically, as an example, if the other request is a request that is generated only when the internal combustion engine is started, the engine rotational speed should not become very high. Therefore, the controller may reference the engine rotational speed as the predetermined information to determine that there has occurred an abnormality if the engine rotational speed is greater than or equal to a predetermined rotational speed. As another example, if the other request is a request that is generated only while the internal combustion engine is stopped, the injected fuel quantity should be zero. Therefore, the controller may reference the injected fuel quantity as the predetermined information to determine that there has occurred an abnormality if the injected fuel quantity is not zero.

The request other than a torque request for the internal combustion engine may be, for example, a startup request, a fail-safe request, a component protection request, or an OBD request. These requests differ from basic requests (e.g., torque request) that are met while the internal combustion engine is in normal operation. For example, the fail-safe and component protection requests have high urgency. If such an urgent request is generated, the request is assigned a greater priority than the torque request. In addition, the startup request, the OBD request, etc. are generated in particular situations, not in normal operation, but assigned a high priority in these particular situations.

Taking the priorities of these requests into consideration, if there exist more than one secondary request value correspondingly to the other requests, such as the startup request, the fail-safe request, the component protection request, and the OBD request, signals that represent the secondary request values preferably contain selection priority information. Furthermore, if the target opening degree calculating section selects any one of the primary request value and the secondary request values in accordance with the priority information, throttle control that is suited to the current, ever-changing engine state can be performed based on the selected suitable request value.

If the signals that represent the secondary request values contain priority information, the controller can determine from the priority information which of the request values has been selected. Accordingly, the abnormality occurrence determining section, when the target opening degree calculating section has selected one of the secondary request values, preferably determines whether or not there has occurred an abnormality in one of the secondary request values that has a top priority. This feature allows for the speeding up of the determination process.

Advantageous Effects of the Invention

As described above, the internal combustion engine controller in accordance with the present invention is not only capable of, when the target throttle opening degree is calculated from a torque request, determining whether or not there has occurred a computational abnormality in the control process, in accordance with the magnitude of deviation of the torque request from the target throttle opening degree, but also capable of, when the target throttle opening degree is calculated from a request other than the torque request, accurately determining whether or not there has occurred an abnormality.

DESCRIPTION OF EMBODIMENTS

The following will describe embodiments of the present invention in reference to drawings. The embodiments will describe a controller in accordance with the present invention being applied to an internal combustion engine in an automobile (hereinafter, an "engine"), especially, to a spark-ignition engine.

Example of Engine Structure

Figure 1:
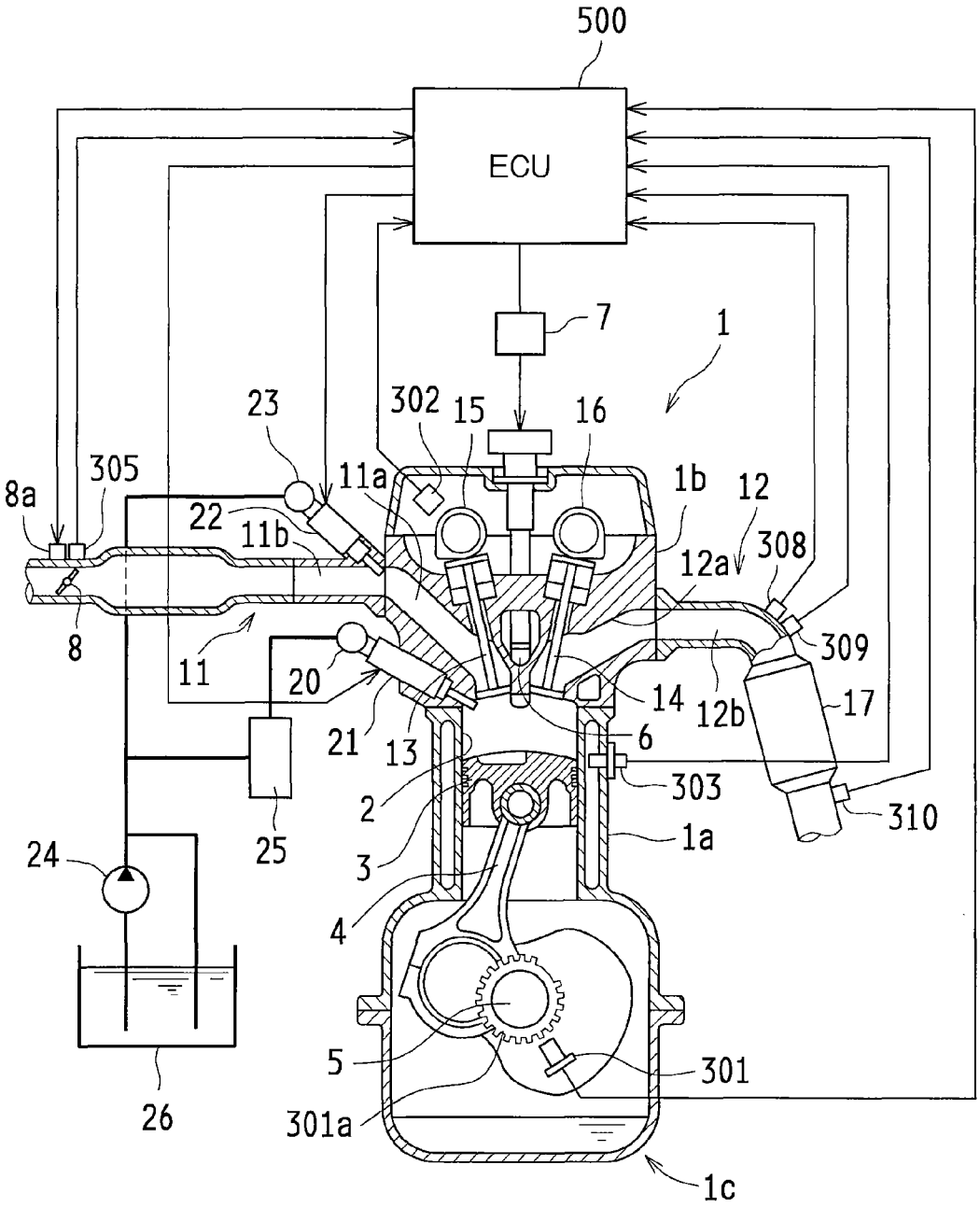
FIG. 1 is a structural diagram of an exemplary internal combustion engine in accordance with an embodiment of the present invention.

First, an exemplary structure of a spark-ignition engine 1 in accordance with the embodiment will be described below in reference to FIG. 1. The figure shows the structure of only one of cylinders 2 in the main body of the engine 1 that may be, for example, an inline 4-cylinder engine. The cylinder 2, provided in a cylinder block 1*a*, contains a piston 3 that moves reciprocally in the vertical direction in the figure. A cylinder head 1*b* is assembled in an upper part of the cylinder block 1*a*. A combustion chamber is located between the bottom face of the cylinder head 1*b* and the top face of the piston 3.

The piston 3 is coupled to a crankshaft 5 via a connecting rod 4. The crankshaft 5 is contained in a crankcase in a lower part of the cylinder block 1*a*. A rotor 301*a* is attached to the crankshaft 5. A crank position sensor 301 built around, for example, an electromagnetic pickup is disposed laterally close to the rotor 301*a*. The crank position sensor 301 outputs a pulse signal when a tooth on the outer circumference of the rotor 301*a* passes before it. Engine rotational speed is calculated from these signals.

A water jacket is formed on a sidewall of the cylinder block 1*a* so as to surround the cylinder 2. A water temperature sensor 303 is disposed on the water jacket to detect the temperature of engine-cooling water w. The cylinder block 1*a* has greater dimensions in the lower part to form an upper half of the crankcase. An oil pan 1*c* is attached to the lower part of the cylinder block 1*a* to form a lower half of the crankcase. The oil pan 1*c* contains lubrication oil (engine oil) which is supplied to various parts of the engine.

A spark plug 6 is disposed in the cylinder head 1*b* so as to face a combustion chamber inside the cylinder 2. An igniter 7 feeds high voltage to an electrode in the spark plug 6. The timing of the high voltage supply to the spark plug 6, that is, the ignition timing of the engine 1, is regulated through the igniter 7. The igniter 7 is an actuator capable of regulating the ignition timing of the engine 1 and is controlled by an ECU (electronic control unit) 500 which will be described later in detail.

The cylinder head 1*b* has an air intake port 11*a* and an exhaust port 12*a* both being opened so as to face the combustion chamber inside the cylinder 2. The air intake port 11*a* is spatially continuous with an air intake manifold 11*b* that forms a downstream part of the intake air path 11 for intake air flow. The exhaust port 12*a* is spatially continuous with an exhaust manifold 12*b* that forms an upstream part of an exhaust path 12 for exhaust gas flow.

An air flow meter 304 (see FIG. 2) is disposed in the upstream part of the intake air path 11 near an air cleaner (not shown) to detect intake air quantity. Downstream from the air flow meter 304 is there provided a throttle valve 8 to regulate intake air quantity. An intake air temperature sensor 307 (see FIG. 2) is also disposed in the intake air path 11 (air intake manifold 11*b*) to detect air temperature (intake air temperature) before the air is taken into the engine 1.

The throttle valve 8, in the present example, is mechanically detached from an accelerator pedal (not shown) and driven by an electric motor 8*a* for the adjustment of its opening degree. Signals from a throttle opening degree sensor 305 that detects the throttle opening degree are transmitted to an ECU 500 (described later in detail). The ECU 500 controls the electric motor 8*a* so as to achieve a suitable intake air quantity in accordance with the operating state of the engine 1. The throttle valve 8 is an actuator that regulates intake air quantity of the engine 1.

In this manner, an intake air valve 13 opens/closes the air intake port 11*a* facing the combustion chamber, which in turn spatially connects/disconnects the intake air path 11 and the combustion chamber. Likewise, an exhaust valve 14 opens/closes the exhaust port 12*a*, which in turn spatially connects/disconnects the exhaust path 12 and the combustion chamber. The intake air and exhaust valves 13 and 14 are driven to open/close by respective air intake and exhaust camshafts 15 and 16 to which the rotation of the crankshaft 5 is transmitted via, for example, timing chains.

In the present example, a cam position sensor 302 is provided near the air intake camshaft 15 to generate a pulse signal when the piston 3 in the particular cylinder 2 reaches a compression top dead center. The cam position sensor 302, built around, for example an electromagnetic pickup, outputs pulse signals as the rotor on the air intake camshaft 15 rotates, similarly to the crank position sensor 301.

Catalyst 17 (for example, three-way catalyst) is disposed downstream from the exhaust manifold 12*b* in the exhaust path 12. The catalyst 17, to clean up exhaust, oxidizes CO and HC to nontoxic $CO_2$ and $H_2O$ and reduces $NO_x$ to nontoxic $N_2$ in the exhaust vented from the combustion chamber inside the cylinder 2 to the exhaust path 12.

In the present example, an air-fuel ratio (A/F) sensor 309 is disposed in the exhaust path 12 upstream from the catalyst 17. In the exhaust path 12 downstream from the catalyst 17 are there disposed an exhaust temperature sensor 308 and an $O_2$ sensor 310.

Fuel Injection System

Next will be described a fuel injection system for the engine 1.

Each cylinder 2 of the engine 1 includes a cylinder-injection injector 21 so as to inject fuel directly into the combustion chamber. The cylinder-injection injectors 21 of the four cylinders 2 are connected to a common high-pressure-fuel feeding pipe 20. In each of the four cylinders 2, a port-injection injector 22 is disposed in the intake air path 11 of the engine 1 so as to inject fuel through each air intake port 11*a*. All the port-injection injectors 22 are connected to a common low-pressure-fuel feeding pipe 23.

Fuel is fed to the high-pressure-fuel feeding pipe 20 and the low-pressure-fuel feeding pipe 23 by a low pressure pump (fuel pump) 24 and a high pressure pump (fuel pump) 25 (hereinafter, may be referred to simply as "fuel pumps 24 and 25"). The low pressure pump 24 draws fuel from a fuel tank 26 to feed the fuel to the low-pressure-fuel feeding pipe 23 and the high pressure pump 25. The high pressure pump 25 pressurizes incoming low pressure fuel to a predetermined or higher pressure level before feeding the fuel to the high-pressure-fuel feeding pipe 20.

In the present example, the high-pressure-fuel feeding pipe 20 has disposed therein a high-pressure-fuel pressure sensor 311 (see FIG. 2) to detect the pressure (fuel pressure) of the high pressure fuel fed to the cylinder-injection injector 21. The low-pressure-fuel feeding pipe 23 has disposed therein a low-pressure-fuel pressure sensor 312 (see FIG. 2) to detect the pressure (fuel pressure) of the low pressure fuel fed to the port-injection injector 22.

The cylinder-injection injector 21 and the port-injection injector 22 are each an electromagnetic actuator that opens a valve to inject fuel in response to the application of a predetermined voltage. The operation (e.g., injection quantity and injection timing) of these injectors 21 and 22 and the operation of the high pressure pump 25 and the low pressure pump 24 are controlled by the ECU 500 (described later in detail).

Either one of the injectors 21 and 22 or both inject fuel into the combustion chamber inside the cylinder 2 to form a gaseous mixture of air and fuel gas in the combustion chamber. The spark plug 6 ignites the gaseous mixture so that the mixture can burn and explode to produce a high-temperature, high-pressure combustion gas that pushes down the piston 3 to rotate the crankshaft 5. The combustion gas is ejected into the exhaust path 12 as the exhaust valve 14 is opened.

ECU

Figure 2:
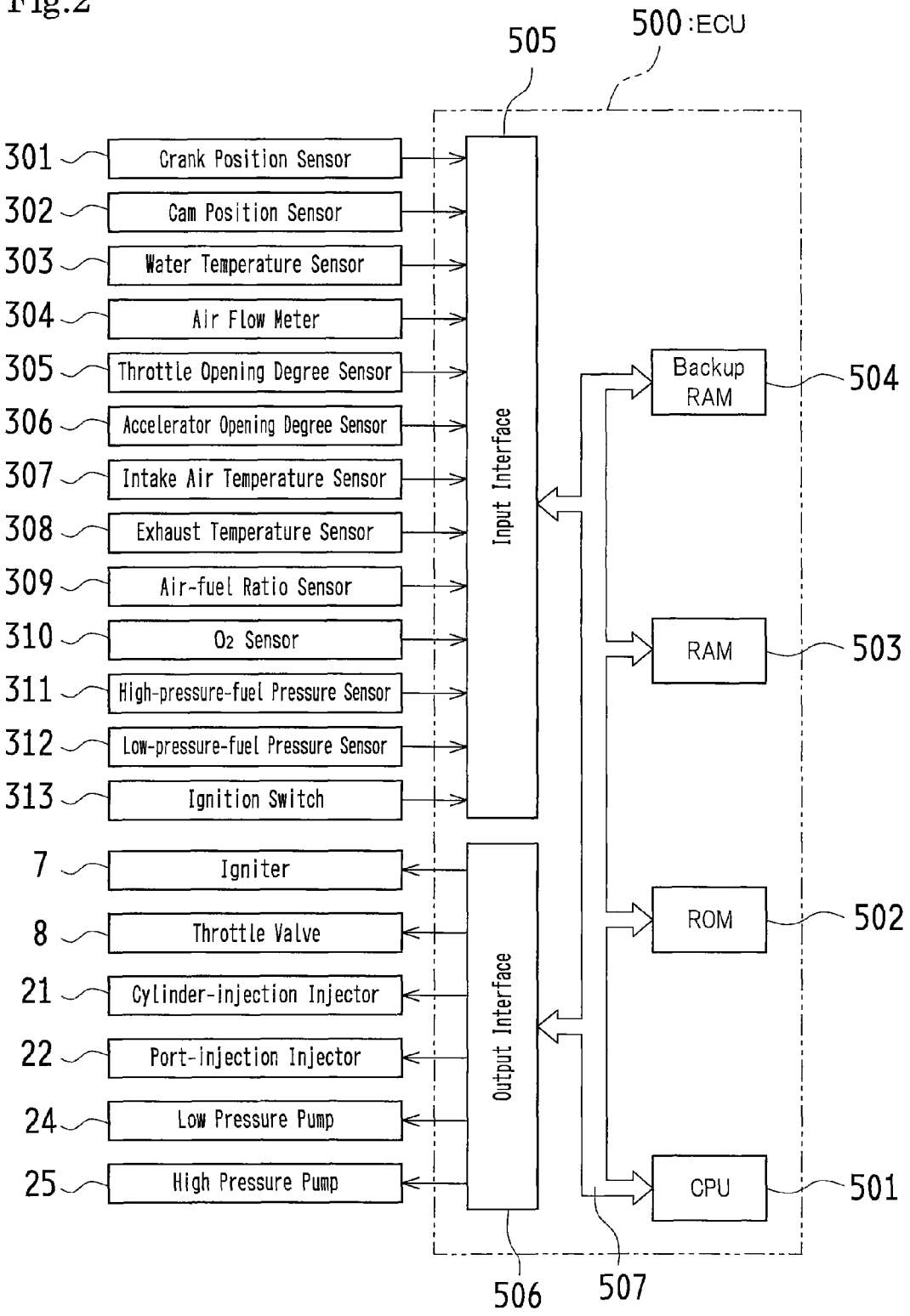
FIG. 2 is a configuration diagram of an exemplary ECU in accordance with the embodiment.

The ECU 500, as schematically represented in FIG. 2, includes, for example, a CPU (central processing unit) 501, a ROM (read-only memory) 502, a RAM (random access memory) 503, and a backup RAM 504.

The ROM 502 stores, for example, various control programs and maps that are referenced when the control programs are executed. The CPU 501 executes various computation processes based on the control programs, maps, etc. stored in the ROM 502. The RAM 503 is a memory that temporarily stores, for example, results of the computation executed by the CPU 501 and input data fed from sensors. The backup RAM 504 is a non-volatile memory that stores, for example, necessary data when the engine 1 is stopped.

The CPU 501, ROM 502, RAM 503, and backup RAM 504 are connected to each other via a bus 507 and also to an input interface 505 and an output interface 506.

The input interface 505 is connected to various sensors, such as the crank position sensor 301, the cam position sensor 302, the water temperature sensor 303, the air flow meter 304, the throttle opening degree sensor 305, an accelerator opening degree sensor 306, the intake air temperature sensor 307, an exhaust temperature sensor 308, the air-fuel ratio sensor 309, the $O_2$ sensor 310, the high-pressure-fuel pressure sensor 311, and the low-pressure-fuel pressure sensor 312.

The input interface 505 is also connected to an ignition switch 313. When the ignition switch 313 is turned on, a starter motor (not shown) starts cranking in the engine 1. The output interface 506 is connected to, for example, the igniter 7 for the spark plug 6, the throttle motor 8*a* for the throttle valve 8, the cylinder-injection injector 21, the port-injection injector 22, the low pressure pump 24, and the high pressure pump 25.

The ECU 500 executes various control processes for the engine 1, including control of the electric supply from the igniter 7 to the spark plug 6, control of the operation of the throttle valve 8 (throttle motor 8*a*), and control of fuel injection by the injectors 21 and 22, based on signals from the sensors 301 to 312 and the switch 313. This configuration enables suitable control of the operating state of the engine 1 while meeting requests for basic functions, such as drivability, exhaust, and fuel economy, in a well-balanced manner.

In other words, the ECU 500 meets the requests related to various functions of the engine 1 by collectively controlling the two or more actuators (igniter 7, throttle valve 8, injectors 21 and 22, etc.). The control programs, executed by the ECU 500, realize an embodiment of the present invention, i.e., an internal combustion engine controller that controls at least a throttle opening degree.

Hierarchical Structure of Controller

Figure 3:
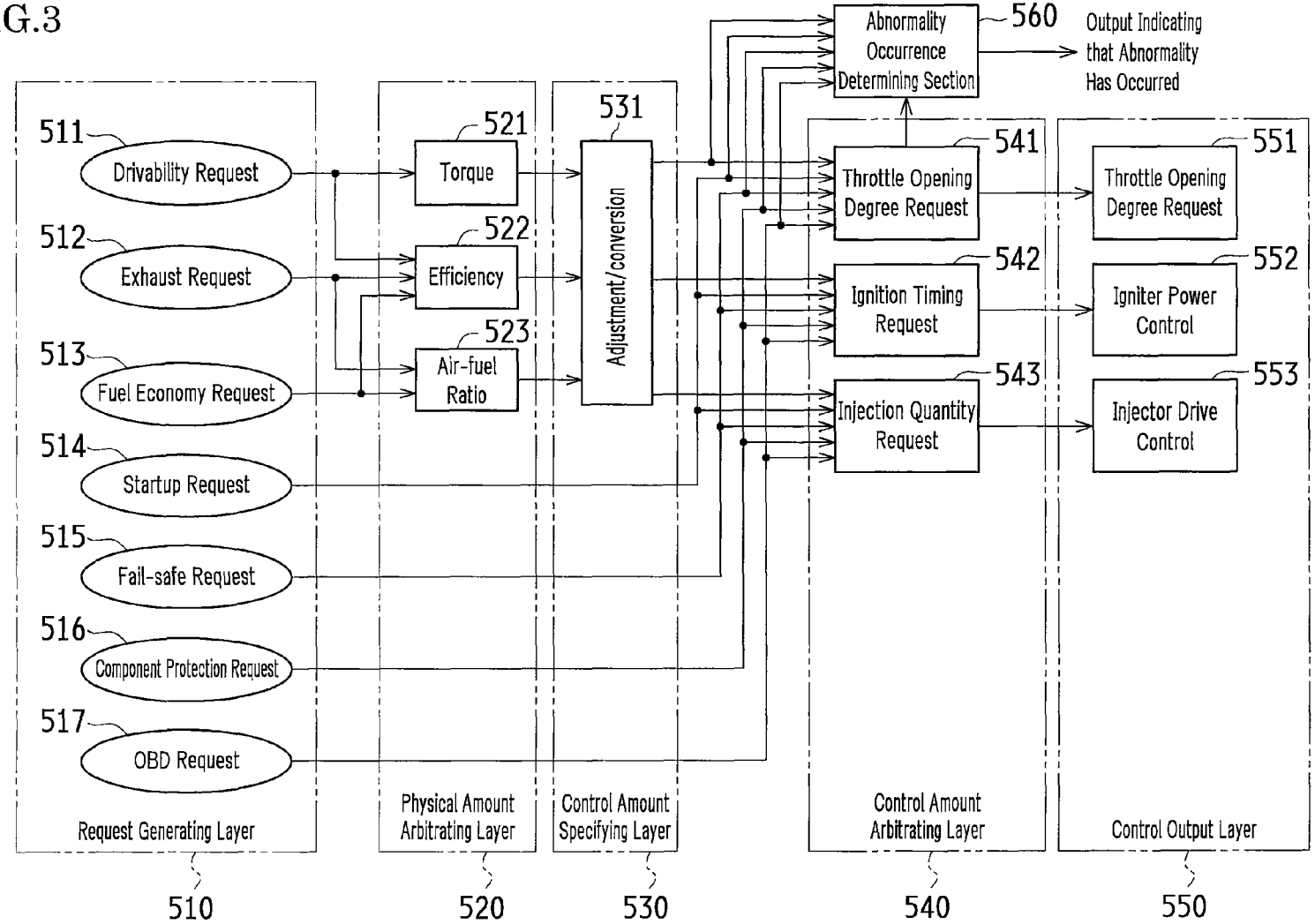
FIG. 3 is a block diagram of an exemplary hierarchical structure of a controller in accordance with the embodiment.

Next, the structure of the controller will be described in detail. FIG. 3 indicates controller elements by blocks and signal transmission by block-connecting arrows. The controller, in the present example, has a hierarchical control structure composed of five layers 510 to 550. Located on the top is a request generating layer 510. Immediately below the layer 510 are a physical amount arbitrating layer 520 and a control amount specifying layer 530. Further down is there provided a control amount arbitrating layer 540. The bottom is a control output layer 550.

Signals flow only in one direction between the five layers 510 to 550: specifically, from the top-level, request generating layer 510 down to the immediately lower, physical amount arbitrating layer 520, then from the physical amount arbitrating layer 520 down to the immediately lower, control amount specifying layer 530, and further from the control amount specifying layer 530 down to the immediately lower, control amount arbitrating layer 540. A common signal supply system (not shown) is provided independently from the layers 510 to 550, to supply common parallel signals to the layers 510 to 550.

There exist the following differences between the signals transmitted between the layers 510 to 550 and the signals supplied by the common signal supply system. The signals transmitted between the layers 510 to 550 represent requests related to the functions of the engine 1 and are ultimately converted to control amounts for the actuators 7, 8, etc. (in the example shown in the figure, the igniter 7, the throttle valve 8, and the injectors 21 and 22). Meanwhile, the signals supplied by the common signal supply system represent information that is needed to generate requests or to compute control amounts.

Specifically, the signals supplied by the common signal supply system represent information related to the operating conditions and state of the engine 1, such as engine rotational speed, intake air quantity, estimated torque, current actual ignition timing, cooling water temperature, and operation mode. These pieces of information come from the sensors 301 to 312 in the engine 1, the estimating functions of the controller, and other like sources. Since the information is common engine information used commonly in the layers 510 to 550, the parallel supply to the layers 510 to 550 reduces communications between the layers 510 to 550 to a minimum and also maintains the simultaneity of information between the layers 510 to 550.

Request Generating Layer

The following will describe the structure of each layer 510 to 550 and the processes performed by that layer 510 to 550. The description will be given layer by layer, starting with the top-level layer. First, the request generating layer 510 includes a plurality of request output sections 511 to 517. The "request" here is related to a function of the engine 1, or in other words, the performance required of the engine 1. Each request output section 511 to 517 handles a different function of the engine 1 which has many different functions. The objects handled by the request output sections in the request generating layer 510 vary depending on what is required of the engine 1 and to which functions a priority is assigned.

The present embodiment assumes that control be performed that achieves basic functions (drivability, exhaust, and fuel economy) in a well-balanced manner so as to efficiently run the engine 1 in response to vehicle manipulation by the driver and also to respond to a demand for environmental protection. For these purposes, in the request generating layer 510, the request output section 511 is provided in correspondence to the drivability-related function, the request output section 512 is provided in correspondence to the exhaust-related function, and the request output section 513 is provided in correspondence to the fuel economy-related function.

Apart from requests for these three basic functions, the present embodiment further considers, for example, a startup request, a fail-safe request, a component protection request, and an OBD request. For this reason, the request generating layer 510 further includes request output sections 514 to 517 (described later in detail) in correspondence to these requests as illustrated in FIG. 3.

The request output sections 511 to 513 quantify requests for basic functions (drivability, exhaust, and fuel economy) of the engine 1 for output. Because the control amounts for the actuators 7, 8, etc. are determined through computation as will be described below, the quantification of requests enables the control amounts for the actuators 7, 8, etc. to be determined with the requests taken into consideration. In the present embodiment, the requests for basic functions are expressed in terms of physical amounts related to the operation of the engine 1.

Only three physical amounts are used: torque, efficiency, and air-fuel ratio. Primary outputs of the engine 1 (in a broader sense of the term) would be torque, heat, and exhaust (heat and components). These outputs are related to the aforementioned functions (drivability, exhaust, and fuel economy). To control these outputs, the three physical amounts, torque, efficiency, and air-fuel ratio, need to be determined. Therefore, the three physical amounts are used to express the requests in the control of the operation of the actuators 7, 8, etc. so that the outputs of the engine 1 can be made with the requests taken into consideration.

FIG. 3 shows, as an example, the request output section 511 outputting a drivability-related request (drivability request) in the form of a request value that represents the request in terms of torque, efficiency, etc. For example, if the request is for vehicle acceleration, the request can be expressed in terms of torque; if the request is for engine failure prevention, the request can be expressed in terms of efficiency (increased efficiency).

The request output section 512 outputs an exhaust-related request in the form of a request value that represents the request in terms of efficiency or air-fuel ratio. For example, if the request is for the warming of the catalyst 17, the request can be expressed in terms of efficiency (reduced efficiency) or air-fuel ratio. When the request is expressed in terms of reduced efficiency, the exhaust temperature may be increased. When the request is expressed in terms of air-fuel ratio, an atmosphere can be created in which reactions proceed smoothly in the presence of the catalyst 17.

The request output section 513 outputs a fuel-economy-related request in the form of a request value that represents the request in terms of efficiency or air-fuel ratio. For example, if the request is for improved combustion efficiency, the request can be expressed in terms of efficiency (increased efficiency); if the request is for reduced pumping loss, the request can be expressed in terms of air-fuel ratio (lean burn).

The request output sections 511 to 513 may output more than one request value for one physical amount. As an example, the request output section 511 outputs not only the torque demanded by the driver (the torque calculated from an accelerator opening degree), but simultaneously also the torques demanded by the VSC (vehicle stability control system), the TRC (traction control system), the ABS (antilock brake system), transmission, and various other vehicle-control-related systems and devices. The same applies to efficiency.

The request generating layer 510 receives common engine information from the common signal supply system. The request output sections 511 to 513 reference the common engine information and determine a request value for output because the request varies depending on the operating conditions and state of the engine 1. For example, if the exhaust temperature sensor 308 measures catalyst temperature, the request output section 512 determines, based on the temperature information, whether or not the catalyst 17 needs to be warmed up and outputs an efficiency request value or an air-fuel ratio request value in accordance with a result of the determination.

As described above, the request output sections 511 to 513 in the request generating layer 510 output a plurality of requests expressed in terms of torque, efficiency, or air-fuel ratio. Not all the requests can be simultaneously and completely met. There may be a plurality of torque requests, but it is only one torque request that can be met. Similarly, there may be a plurality of efficiency requests, but it is only one efficiency request that can be met. Again, there may be a plurality of air-fuel ratio requests, but it is only one air-fuel ratio request that can be met. Thus, the requests need to be arbitrated.

Physical Amount Arbitrating Layer

The physical amount arbitrating layer 520 arbitrates the request value outputs of the request generating layer 510. The physical amount arbitrating layer 520 includes arbitrating sections 521 to 523, one for each kind of physical amount that represents requests. The arbitrating section 521 collects and arbitrates the request values that indicate torques (torque request values) in order to output a single torque request value. The arbitrating section 522 collects and arbitrates the request values that indicate efficiencies (efficiency request values) in order to output a single efficiency request value. The arbitrating section 523 collects and arbitrates the request values that indicate air-fuel ratios (air-fuel ratio request values) in order to output a single air-fuel ratio request value.

The arbitrating sections 521 to 523 arbitrate request values according to a predetermined set of rules. The "rules" here are procedures of calculation to obtain a single numeric value from a plurality of numeric values, such as the selection of a maximum value, the selection of a minimum value, the calculation of an average, and superimposition. The rules may be a suitable combination of these procedures of calculation. The rules may be designed freely and are not limited in any manner in the present invention.

The physical amount arbitrating layer 520 also receives common engine information from the common signal supply system so that the common engine information is available to the arbitrating sections 521 to 523. For example, the arbitration rules may be altered depending on the operating conditions and state of the engine 1. The rules are however not altered by taking the performance range of the engine 1 into consideration as will be described in the following.

The arbitrating sections 521 to 523 do not take a maximum and a minimum torque that can actually be achieved by the engine 1 into consideration in the arbitration process. In addition, none of the arbitrating sections 521 to 523 takes the results of the arbitration performed by the other arbitrating sections into consideration in its own arbitration process. In other words, each arbitrating section 521 to 523 arbitrates request values without taking into consideration the maximum and the minimum value of the performance range of the engine 1 and the results of the arbitration performed by the other arbitrating sections. This configuration also contributes to the reducing of control computation load.

The arbitrating sections 521 to 523 arbitrate request values as described in the foregoing, so that the physical amount arbitrating layer 520 can output one torque request value, one efficiency request value, and one air-fuel ratio request value. The control amount specifying layer 530, or the layer immediately below the physical amount arbitrating layer 520, specifies a control amount for each actuator 7, 8, etc. based on the torque request value, efficiency request value, and air-fuel ratio request value obtained from the arbitration.

Control Amount Specifying Layer

In the present embodiment, the control amount specifying layer 530 includes a single adjustment/conversion section 531 to firstly adjust the magnitudes of the torque request value, efficiency request value, and air-fuel ratio request value obtained from the arbitration performed by the physical amount arbitrating layer 520. As mentioned earlier, the physical amount arbitrating layer 520 arbitrates request values without taking the performance range of the engine 1 into consideration. Therefore, the engine 1 may not be properly run depending on the magnitudes of the request values. Accordingly, the adjustment/conversion section 531 adjusts request values based on the mutual relationship of the request values, so that the engine 1 can be properly run.

In the layers above the control amount specifying layer 530, the torque request value, efficiency request value, and air-fuel ratio request value are independently computed; no computing element exchanges computation values or references values computed by the other elements. In other words, the control amount specifying layer 530 allows, for the first time, its element to mutually reference the torque request value, efficiency request value, and air-fuel ratio request value. Only the three values (torque request value, efficiency request value, and air-fuel ratio request value) are adjusted, which maintains low computation load required for the adjustment.

The adjustment may be designed freely. The adjustment is not limited in any manner in the present invention. If there is priority between the torque request value, efficiency request value, and air-fuel ratio request value, however, it is preferable to adjust (moderate) a request value with a low priority. For example, a request value with a high priority should be preserved where possible so that the raw request value can be used in determining control amounts for the actuators 7, 8, etc., whereas a request value with a low priority should be adjusted before determining control amounts for the actuators 7, 8, etc.

In this configuration, a request with a high priority can be sufficiently met within the range where the engine 1 can be properly run, whereas a request with a low priority can be partially met. As an example, if the torque request value has the highest priority, the efficiency request value and the air-fuel ratio request value are moderated, with one of the request values that has a lower priority being moderated to a greater extent. If priority varies depending on, for example, the operating conditions of the engine 1, priority may be assigned based on the common engine information fed from the common signal supply system so as to determine which request value to moderate.

The control amount specifying layer 530 generates new signals from the request values fed from the physical amount arbitrating layer 520 and the common engine information fed from the common signal supply system. For example, a dividing section (not shown) calculates a ratio of the torque request value obtained from the arbitration performed in the arbitrating section 521 and an estimated torque contained in the common engine information. The estimated torque is a torque output achieved when ignition occurs at an MBT timing under the conditions of the current intake air quantity and air-fuel ratio. The estimated torque is calculated in another task of the controller.

When the torque request value has the highest priority as in the aforementioned case, the control amount specifying layer 530 outputs (calculates) a torque request value, a moderated efficiency request value, a moderated air-fuel ratio request value, and a torque efficiency as a result of the process above (detailed description is omitted). Of these request values (signals), the control amount specifying layer 530 uses the torque request value and the moderated efficiency request value to calculate a throttle opening degree (converts the torque request value and the moderated efficiency request value to a throttle opening degree) for output to the control amount arbitrating layer 540.

Specifically, first, the torque request value is divided by the moderated efficiency request value. The division increases the torque request value because the moderated efficiency request value is less than or equal to 1. The increased torque request value is converted to an air quantity from which a throttle opening degree is calculated. The conversion of the torque request value to an air quantity and the calculation of a throttle opening degree from the air quantity are both performed by referencing a pre determined map.

An ignition timing is primarily calculated from the torque efficiency (the torque efficiency is primarily converted to an ignition timing). In the calculation, for example, the torque request value and the moderated air-fuel ratio request value are also used as reference signals. Specifically, a phase lag for an MBT timing is calculated from the torque efficiency by referencing a map. The phase lag grows larger with a lower torque efficiency, which results in a lower torque. The increasing of the torque request value is a process to compensate for the reduction in torque caused by the phase lag.

In the present embodiment, both the torque request value and the efficiency request value are satisfied by the combination of the phase lag in ignition timing calculated from the torque efficiency and the increasing of the torque request value based on the efficiency request value. The torque request value and the moderated air-fuel ratio request value are used to choose a map by which a torque efficiency is converted to a phase lag. An ultimate ignition timing is calculated from the phase lag and MBT (or the base ignition timing).

An injected fuel quantity is calculated from the moderated air-fuel ratio request value and the intake air quantity for the cylinder 2 in the engine 1. The intake air quantity is contained in the common engine information and fed from the common signal supply system to the adjustment/conversion section 531.

As a result of the process above, the signals transmitted from the control amount specifying layer 530 (adjustment/conversion section 531) to the control amount arbitrating layer 540 contain a throttle opening degree request value (primary request value corresponding to the torque request), an ignition timing request value, and an injected fuel quantity request value. The signals are fed to the respective arbitrating sections 541, 542, and 545 in the control amount arbitrating layer 540 and arbitrated together with other request values transmitted directly from the request generating layer 510 (detailed description is omitted).

Control Amount Arbitrating Layer

As an example, the control amount arbitrating layer 540 includes arbitrating sections 541 to 543, one for each kind of control amounts for the actuators 7, 8, etc. that represents requests as illustrated in FIG. 3. In the example shown in the figure, the arbitrating section 541 collects and arbitrates throttle opening degree request values in order to output a single request value. The arbitrating section 542 collects and arbitrates ignition timing request values to output a single request value. The arbitrating section 543 collects and arbitrates injected fuel quantity request values to output a single request value.

The arbitrating sections 541 to 543 arbitrate request values according to a predetermined set of rules, similarly to the arbitrating sections 521 to 523 in the physical amount arbitrating layer 520. The rules may be designed freely and are not limited in any manner in the present invention. In the arbitrations performed in the control amount arbitrating layer 540, however, transmission signals represent requests with pre-assigned priorities in accordance with which arbitrations are performed, which will be described later in detail.

The control amount arbitrating layer 540 also receives the common engine information from the common signal supply system so that the common engine information is available to the arbitrating sections 541 to 543. The throttle opening degree request value arbitrating section 541 is connected to an abnormality occurrence determining section 560 so that the abnormality occurrence determining section 560 can determine whether or not a RAM alteration or another like computational abnormality has occurred in the control process, as illustrated in FIG. 3. These determinations as to the occurrence of abnormalities will be described later in detail.

The arbitrating sections 541 to 543 arbitrate request values as described in the foregoing, so that the control amount arbitrating layer 540 can at least output one throttle opening degree request value, one ignition timing request value (or one ignition cutoff request value), one set of injection quantity request values (or one set of injection cutoff request values) for the set of injectors 21 and 22, and one set of injection timing request values.

Control Output Layer

The control output layer 550, or the layer immediately below the control amount arbitrating layer 540, calculates control amounts for the actuators 7, 8, etc. based on these request values. The control output layer 550, or the bottom-level layer, in the example shown in the figure, includes control output sections 551 to 553 correspondingly to the incoming signals from the control amount arbitrating layer 540. The control output section (throttle drive control section) 551 receives a throttle opening degree request value from the throttle opening degree request value arbitrating section 541. Based on the throttle opening degree request value, the control output section 551 outputs a throttle drive signal.

The control output section (igniter power control section) 552 receives an ignition timing request value from the ignition timing request value arbitrating section 542 in the control amount arbitrating layer 540. Based on the ignition timing request value, the control output section 552 outputs an igniter power signal. The control output section (injector drive control section) 553 receives an injection quantity request value from the injection quantity arbitrating section 543. Based on the injection quantity request value, the control output section 553 outputs an injector drive signal.

Arbitrating Actuator Control Amounts

Next will be described the arbitration of actuator control amounts in the control amount arbitrating layer 540 described above. The arbitration of throttle opening degree request values, which is a feature of the present embodiment, will be described especially in reference to FIG. 4, as well as to FIG. 3.

First, as mentioned earlier, the controller in accordance with the present embodiment expresses the requests for basic functions (drivability, exhaust, and fuel economy) of the engine 1 in terms of combinations of three physical amounts (torque, efficiency, and air-fuel ratio) so that the physical amount arbitrating layer 520 can arbitrate the requests. Various requests other than those for these basic functions may also be used. For example, some requests, such as those related to fail-safe and component protection, have high urgency. Converting these requests temporarily into request values that indicate torque, efficiency, or air-fuel ratio before arbitration introduces an extra computation load, which could negatively affect high speed processing.

Besides those requests that are generated in normal operation of the engine 1, there are also some requests that are generated only in particular situations, such as upon a startup, in a stationary state, and during OBD. For the purpose of arbitration, these requests can be simply expressed in terms of a sequence of control for the throttle opening degree, the injected fuel quantity, the ignition timing, etc. The converting of the requests into torque or another physical amount before arbitration makes little sense and introduces an extra computation load as in the case of a fail-safe request.

Considering these facts and views, the request generating layer 510 in accordance with the present embodiment includes, for example, the request output sections 514 to 517 respectively in correspondence to the startup request, the fail-safe request, the component protection request, and the OBD request as shown in FIG. 3 detailed above. The request output sections 514 to 517 respectively output requests that do not indicate physical amounts, but are in the form of request values indicating control amounts for the actuators 7, 8, etc. and transmit the request values directly to the control amount arbitrating layer 540 without passing through the physical amount arbitrating layer 520 or the control amount specifying layer 530.

These request values, together with the request values for the throttle opening degree, ignition timing, or injected fuel quantity transmitted from the control amount specifying layer 530 to the control amount arbitrating layer 540 as mentioned earlier, are collected and arbitrated separately for each kind of control amount by the arbitrating sections 541 to 543 in the control amount arbitrating layer 540 to output a single request value.

Figure 4:
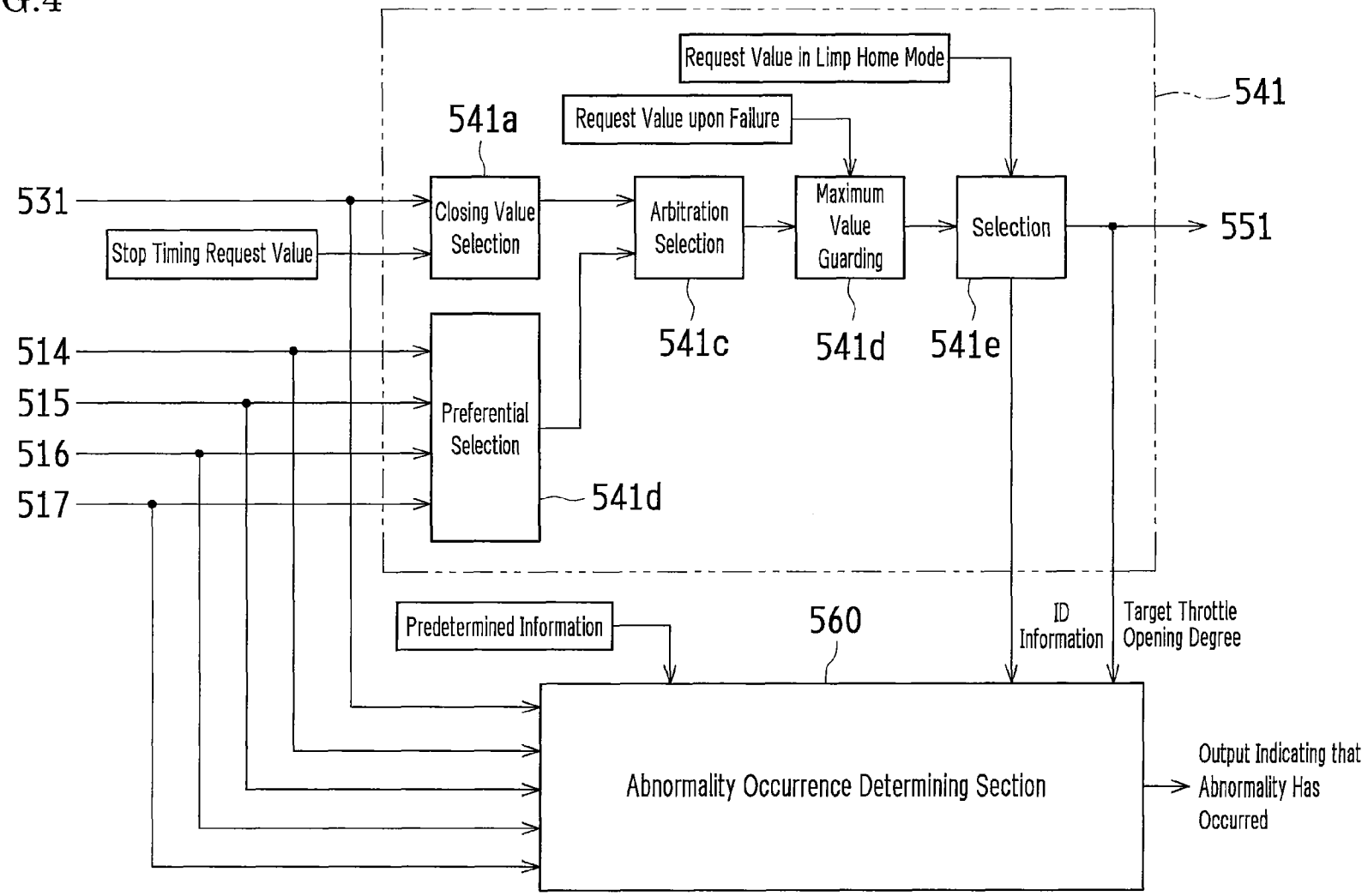
FIG. 4 is a block diagram of exemplary arbitration of a request value for a throttle opening degree in accordance with the embodiment.

As an example, as illustrated in FIG. 4, the throttle opening degree request value arbitrating section 541 receives a signal that represents a throttle opening degree request value (primary request value) in correspondence to a torque request from the adjustment/conversion section 531 in control amount specifying layer 530 as mentioned earlier. In the example shown in the figure, when the engine 1 is to be stopped, the arbitrating section 541 is fed also with a stop timing request value to close the throttle valve 8 for the reduction of vibration. A closing value selecting section 541*a* in the arbitrating section 541 then selects one of the two request values that indicates that the throttle valve 8 is to be closed.

As mentioned earlier, the arbitrating section 541 is fed also with signals that represent, for example, throttle opening degree request values (secondary request values) respectively in correspondence to the startup request, the fail-safe request, the component protection request, and the OBD request from the request output sections 514 to 517 in the request generating layer 510. The signals from the request output sections 514 to 517 in the present embodiment contain information (ID) that identifies the individual request output sections 514 to 517 and represents the pre-assigned priorities of the requests.

As an example, the highest priority may be assigned to the startup request while the engine 1 is stopped and to the fail-safe request when the engine 1 is running, with the second and the third highest priority being assigned to the component protection request and the OBD request. All these requests are assigned a higher priority than the basic requests (drivability, exhaust, and fuel economy) that are generated when the engine is running. Thus, for example, the signal for the primary request value that corresponds to the torque request contains ID=0, and the signals for the secondary request values that correspond to the startup request, the fail-safe request, the component protection request, and the OBD request contain ID=1, 2, 3, and 4 respectively.

In the present embodiment, a smaller numeral designation indicates a higher priority, except for the case of ID=0. For example, upon a startup of the engine, a signal is transmitted that represents an "ID=1", which indicates a throttle opening degree request value upon a startup. Therefore, if signals representing the other kinds of request values are transmitted, the throttle opening degree request value upon a startup, which has the highest priority, is selected. The selection is performed by a preferential selection section 541*b* in the arbitrating section 541. The preferential selection section 541*b* selects only the request value with the highest priority from the incoming signals that represent secondary request values.

The preferentially selected signal representing a secondary request value and the signal representing a primary request value are fed to an arbitration selecting section 541*c* where either one of the signals is selected (arbitration) according to a predetermined set of rules. The selection may be performed by any method. For example, if the only incoming signal represents a primary request value with ID=0, this signal is selected. On the other hand, if other incoming signals represent secondary request values with ID=1 to 4, one of the signals that has the highest priority is selected. Alternatively, a signal representing either a primary request value or a secondary request value may be selected before giving a weight to the selected one of the request values and calculating a request value using, for example, a weighted average so that the non-selected one of the request values is also taken into consideration.

The selected request value (result of arbitration) is transmitted from the arbitration selecting section 541*c* to a maximum value guarding section 541*d*. In this embodiment, a maximum value is guarded so that the engine torque does not overshoot if the driver excessively depresses the accelerator pedal upon a failure. In other words, if a fail-safe process restricts the engine torque, the driver may temporarily excessively depress the accelerator pedal. If the fail-safe process is implemented by mistake and subsequently disabled, the engine torque could surge.

The maximum value guarding section 541*d* limits an incoming throttle opening degree request value to a level less than or equal to a predetermined guarding level to output the resulting value. The output request value is transmitted to the selecting section 541*e* where a selection is made between that request value and a throttle opening degree request value in limp home mode. The latter request value is a throttle opening degree that is predetermined so as to enable the vehicle to run in limp home mode and is selected in predetermined situations where the vehicle is unable to travel in normal mode due to a malfunction of the engine 1.

The throttle opening degree request value selected as described above (result of arbitration), that is, the target throttle opening degree, is fed from the selecting section 541*e* (i.e., from the arbitrating section 541) to the control output section 551 which responds to the request value by feeding a throttle drive signal to the throttle motor 8*a*. The throttle motor 8*a* then operates to suitably control the opening degree of the throttle valve 8 in accordance with various conditions and situations, such as the operating state, startup, failure, and OBD of the engine 1.

In other words, in the present embodiment, the throttle opening degree arbitrating section 541 constitutes a target opening degree calculating section that selects either a primary request value corresponding to a torque request or a secondary request value corresponding to another request, such as startup, fail-safe, component protection, or OBD, to calculate a target throttle opening degree.

Determining Occurrence of Computational Abnormality in Control Process

The abnormality occurrence determining section 560 is provided in the present embodiment to detect a computational abnormality in the control process performed by the throttle opening degree arbitrating section 541. Computational abnormalities, such as so-called RAM alterations and RAM value abnormalities, can occur in the control process if data is not correctly written to the RAM due to, for example, noise or a transient voltage drop in the ECU 500. An abnormality may lead to an excessively high target throttle opening degree, resulting in unintended excessive engine torque generation. That could in turn cause the driver to have a sense of strangeness.

Figure 5:
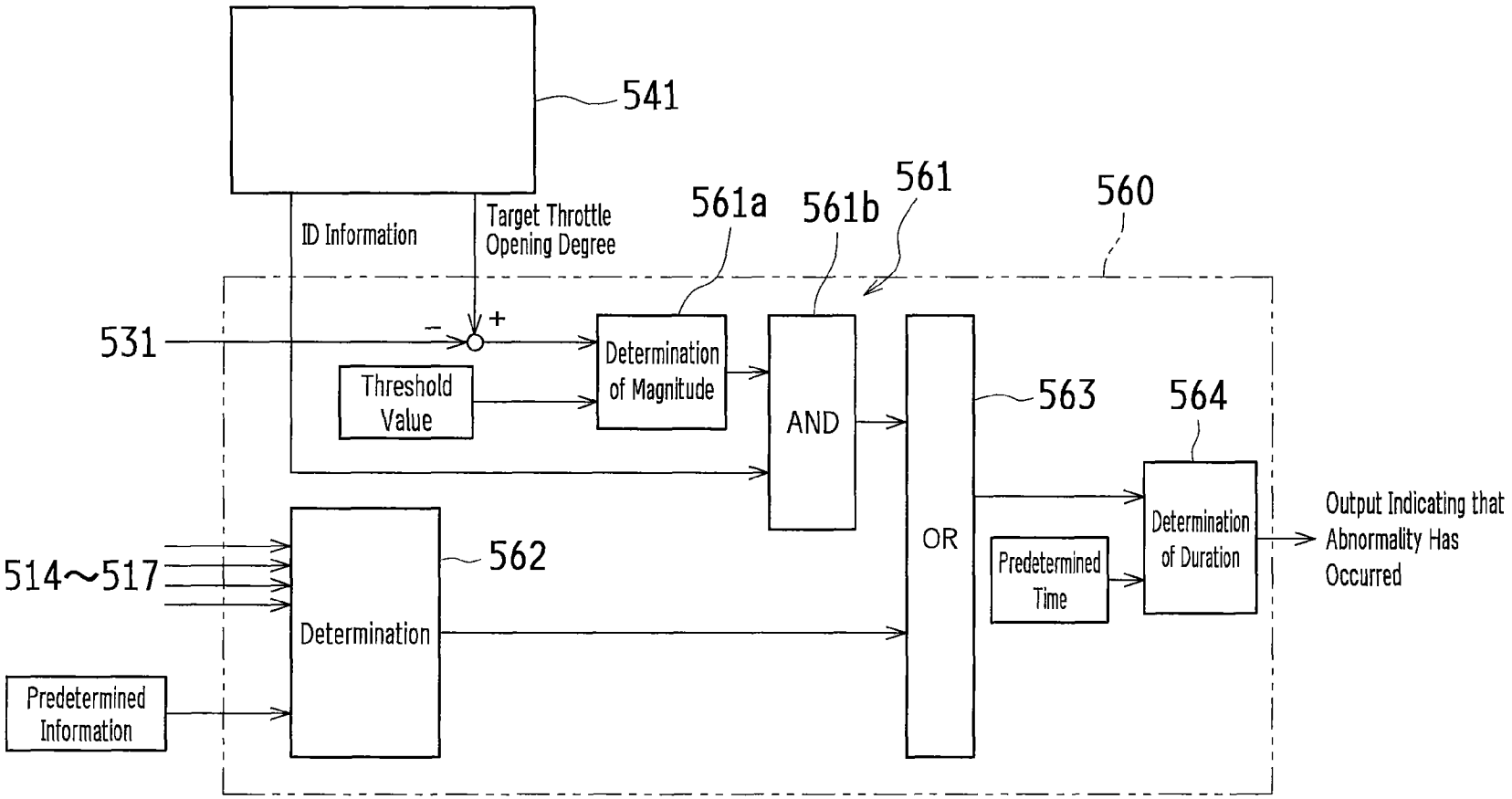
FIG. 5 is a block diagram of exemplary abnormality occurrence determination by a throttle opening degree request arbitrating section.

This is addressed by the present embodiment by the provision of the abnormality occurrence determining section 560 as shown in FIG. 5, as well as in FIG. 4. The abnormality occurrence determining section 560 determines the occurrence of the computational abnormalities in the control process based on the signals representing both the primary and secondary request values of the throttle opening degree transmitted to the arbitrating section 541, the ID-information-representing signal fed from the arbitrating section 541 when a primary request value corresponding to a torque request (ID=0) is selected, and the signal representing the target throttle opening degree transmitted from the arbitrating section 541 to the control output section 551.

In the example shown in the figure, the abnormality occurrence determining section 560 includes a first determining section 561 and a second determining section 562. The first determining section 561 determines the occurrence of an abnormality from the magnitude of a deviation between the primary request value for the throttle opening degree and the target throttle opening degree. The second determining section 562 determines the occurrence of an abnormality, for example, from the magnitude of the target throttle opening degree. Specifically, the first determining section 561 includes a magnitude determining section 561*a* that subtracts the primary request value for the throttle opening degree from the target throttle opening degree to determine which one of the absolute value of the deviation and a predetermined threshold value is greater than the other.

The first determining section 561 also includes an AND gate section 561*b* that is fed with a signal output of the magnitude determining section 561*a* when the deviation in absolute value between the target throttle opening degree and the primary request value is greater than the threshold value and an ID-information-representing signal from the arbitrating section 541. The signal output of the AND gate section 561*b* is fed to an OR gate section 563. A signal output of the second determining section 562 is also fed to the OR gate section 563.

The second determining section 562 determines the occurrence of an abnormality in one of secondary request values that has the highest priority as described later in detail. Upon receiving a signal input from either the first or second determining section 561 or 562, the OR gate section 563 outputs a signal to a duration determining section 564. If this continues up to or in excess of a predetermined time, the duration determining section 564 outputs a result of the determination indicating that an abnormality has occurred.

Figure 6:
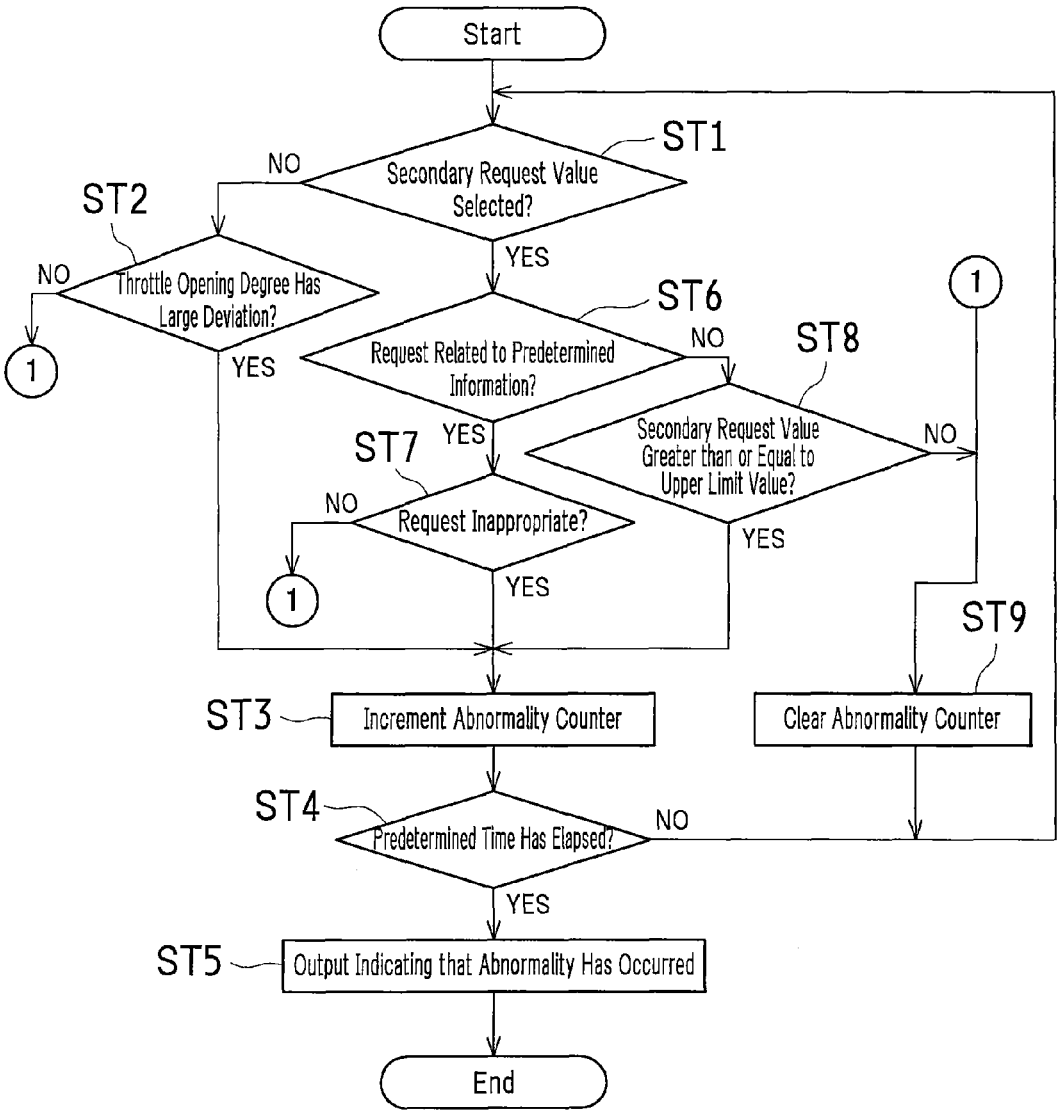
FIG. 6 is a flow chart depicting exemplary specific abnormality occurrence determining steps.

The following will describe an abnormality occurrence determining routine implemented by the first and second determining sections 562 in more concrete terms also in reference to the flow chart in FIG. 6. The routine is repeatedly implemented by the ECU 500 at predetermined time intervals (e.g., every few tens of milliseconds).

First, the ECU 500 determines, from the ID-information-representing signal fed from the throttle opening degree arbitrating section 541 to the abnormality occurrence determining section 560, which of the primary and secondary request values of the throttle opening degree has been selected (an arbitration has been performed) (step ST1). The ID-information-representing signal is output from the arbitrating section 541 and fed to the AND gate section 561*b* in the first determining section 561 when ID=0 as described earlier. Therefore, if this signal is being fed to the AND gate section 561*b*, the ECU 500 determines that the primary request value has been selected ("NO" in step ST1) and proceeds to step ST2.

In step ST2, the ECU 500 determines whether or not the magnitude in absolute value of the deviation of the throttle opening degree is above a threshold value. If the throttle opening degree is not above a threshold value ("NO" in step ST2), the ECU 500 proceeds to step ST9 (detailed later). On the other hand, if the throttle opening degree is above the threshold value ("YES" in step ST2), the ECU 500 proceeds to step ST3 where an abnormality counter is incremented. Specifically, if the deviation is above a threshold value, the signal output of the magnitude determining section 561*a* in FIG. 5 is fed to the AND gate section 561*b* whose output signal is fed to the OR gate section 563 whose output signal is in turn fed to the duration determining section 564 to increment the abnormality counter.

Depending on whether or not the abnormality counter reading, incremented in this manner, has reached a predetermined value, the ECU 500 determines whether or not a predetermined time has elapsed (step ST4). If the predetermined time has not elapsed yet ("NO" in step ST4), the ECU 500 returns to step ST1. On the other hand, if the predetermined time has elapsed ("YES" in step ST4), the ECU 500 outputs a result of the determination indicating that an abnormality has occurred (step ST5). Specifically, if the primary request value for the throttle opening degree has been selected, the occurrence of an abnormality is determined from the magnitude of the deviation between the primary request value and the target throttle opening degree. If this continues up to or in excess of the predetermined time, the result of the determination indicating that an abnormality has occurred is output.

On the other hand, if the arbitrating section 541 has output no ID-information-representing signal, and the ECU 500 determines in step ST1 that the secondary request value has been selected ("YES" in step ST1), the ECU 500 proceeds to step ST6 where the ECU 500 determines whether or not the secondary request value represents a request related to predetermined information that represents the state of the engine 1. The "predetermined information" represents various states of the engine 1, such as engine rotational speed, intake air quantity, injected fuel quantity, current actual ignition timing, and cooling water temperature, and is used to determine whether or not the request can be generated in the state of the engine 1 indicated in the information.

In other words, as mentioned earlier, the signals representing the secondary request values of the throttle opening degree contain, for example, ID=1 to 4 respectively in correspondence to the startup request, the fail-safe request, the component protection request, and the OBD request. The ECU 500, in step ST6, determines whether or not each request is related to the state of the engine 1 indicated in the predetermined information. If any of the requests is not related to the state of the engine 1 indicated in the predetermined information ("NO" in step ST 6), the ECU 500 proceeds to step ST8 (detailed later). On the other hand, if each request is related to the state of the engine 1 indicated in the predetermined information ("YES" in step ST6), the ECU 500 proceeds to step ST7.

In step ST7, as mentioned earlier, the ECU 500 determines whether or not the secondary request value can be output in the state of the engine 1 indicated in the predetermined information, in other words, whether or not the request is inappropriate. For example, the engine rotational speed does not become very high when the engine 1 is started. Therefore, the ECU 500 determines that the request is inappropriate ("YES" in step ST7) if the engine rotational speed is greater than or equal to a predetermined rotational speed when the secondary request value indicates a startup request. Similarly, the ECU 500 may reference the injected fuel quantity as the predetermined information and if this is not zero, determine that the request is inappropriate only while the engine 1 is stopped.

If the request is not inappropriate ("NO" in step ST7), the ECU 500 proceeds to step ST9 (detailed later). On the other hand, if the request is inappropriate ("YES" in step ST7), the ECU 500 proceeds to step ST3 where the abnormality counter is incremented. Specifically, referring to FIG. 5, the signal output of the second determining section 562 is fed to the OR gate section 563 whose output signal is fed to the duration determining section 564 to increment the abnormality counter.

If the secondary request value is not a request related to the predetermined information ("NO" in step ST6), the ECU 500 proceeds to step ST8 where the ECU 500 determines whether or not the secondary request value is greater than or equal to a predetermined upper limit value. This upper limit value is a predetermined, impossible value of the throttle opening degree in the current state of the engine 1 and may be, for example, a throttle opening degree of about 15° if the engine 1 is idling.

If the throttle opening degree request value (secondary request value) is greater than or equal to the upper limit value ("YES" in step ST8), indicating that an abnormality has occurred, the ECU 500 proceeds to step ST3 where abnormality counter is incremented. If the abnormality counter reading thus incremented has reached a predetermined value ("YES" in step ST4), the ECU 500 outputs a result of the determination indicating that an abnormality has occurred as mentioned earlier (step ST5). On the other hand, if the secondary request value is not greater than or equal to the upper limit value ("NO" in step ST8), the ECU 500 proceeds to step ST9 where the abnormality counter is cleared.

In other words, when the secondary request value of the throttle opening degree has been selected, the ECU 500 determines that an abnormality has occurred either if the secondary request value is greater than or equal to the predetermined upper limit value or if the secondary request value is not generated in the current state of the engine 1. If either one of these states continues up to or in excess of the predetermined time, the ECU 500 outputs the result of the determination indicating that an abnormality has occurred.

Therefore, the controller in accordance with the present embodiment expresses the drivability and other like basic function requests in terms of predetermined physical amounts and arbitrates those requests to control the engine 1 to remain in a suitable operating state where basic requests for the engine 1 are met in a well-balanced manner. Meanwhile, the controller expresses the startup, fail-safe, and other like requests in terms of control amounts for the throttle valve 8 and other actuators to arbitrate the requests.

Hence, the throttle opening degree arbitrating section 541 arbitrates the primary request value that corresponds primarily to a torque request and one of the secondary request values that correspond to other requests to calculate a target throttle opening degree. If the target throttle opening degree is calculated from the primary request value, the abnormality occurrence determining section 560 may determine whether or not a computational abnormality has occurred in the control process, from the magnitude of the deviation between the torque request and the target throttle opening degree.

On the other hand, if the target throttle opening degree is calculated from one of the secondary request values, the abnormality occurrence determining section 560 cannot determine, from the deviation between the torque request and the target throttle opening degree, whether or not an abnormality has occurred. However, depending on whether the secondary request value is not generated in the current state of the engine 1 or is greater than or equal to a predetermined upper limit value, it can be determined whether or not an abnormality has occurred.

In other words, by switching between abnormality occurrence determining methods according to how the target throttle opening degree is calculated, computational abnormalities in the control process can be accurately detected also when the target throttle opening degree is calculated taking not only the torque request, but also other requests, into consideration.

Other Embodiments

Exemplary embodiments of the present invention have been described so far. The present invention is by no means limited to these embodiments and may be altered within the scope of the present invention. For example, in the embodiments, when the target throttle opening degree is calculated from one of the secondary request values of the throttle opening degree, it is determined whether or not an abnormality has occurred, depending on whether the secondary request value is not generated in the current state of the engine 1 or is greater than or equal to a predetermined upper limit value. Alternatively, an abnormality may be determined to have occurred only if the secondary request value is greater than or equal to the upper limit value.

In the embodiments, the signals representing secondary request values contain information (ID) that identifies the individual request output sections 514 to 517 and represents priorities of requests. This is by no means intended to limit the present invention. Alternatively, no priorities may be assigned to requests in advance.

The controller in accordance with the embodiments expresses requests for the basic functions of the engine 1 in terms of predetermined physical amounts and expresses the other requests in terms of control amounts for actuators, in order to arbitrate the requests. This is again by no means intended to limit the present invention. Alternatively, the present invention may be applied to an engine controller that selects either a primary request value that corresponds to a torque request and a secondary request value that corresponds to another request, to calculate a target throttle opening degree.

In the embodiments, the controller in accordance with the present invention is applied to the spark-ignition engine 1 in a vehicle. Alternatively, the present invention is applicable to engines other than the spark-ignition engine 1, such as diesel engines, and also applicable to engines in hybrid systems that include an electric motor.

INDUSTRIAL APPLICABILITY

The internal combustion engine controller in accordance with the present invention is capable of accurately detecting an abnormality when the target throttle opening degree is calculated from a request other than a torque request and therefore useful when mounted to a vehicle.

REFERENCE SIGNS LIST

1 Engine (Internal Combustion Engine)
8 Throttle Valve
500 ECU
540 Control Amount Arbitrating Layer
541 Throttle Opening Degree Arbitrating Section (Target Opening Degree Calculating Section)
560 Abnormality Occurrence Determining Section

The invention claimed is:

1. An internal combustion engine controller that controls at least a throttle opening degree, said controller comprising:

a target opening degree calculating section that selects either a primary request value for a throttle opening degree that corresponds to a torque request for an internal combustion engine or a secondary request value for a throttle opening degree that corresponds to another request and that calculates a target throttle opening degree from the selected one of the primary and secondary request values; and an abnormality occurrence determining section that, if the target opening degree calculating section has selected the primary request value, determines whether or not there has occurred an abnormality, in accordance with a magnitude of a deviation of the primary request value from the target throttle opening degree and that, if the target opening degree calculating section has selected the secondary request value, determines whether or not there has occurred an abnormality, in accordance with whether or not the target throttle opening degree is greater than or equal to a predetermined upper limit value.

2. The controller as set forth in claim 1, wherein the abnormality occurrence determining section, when the target opening degree calculating section has selected the secondary request value, references predetermined information related to a state of the internal combustion engine and determines that there has occurred an abnormality even if the other request is not generated while the internal combustion engine is in the state.

3. The controller as set forth in claim 2, wherein the other request is generated only when the internal combustion engine is started, the predetermined information represents an engine rotational speed, and the abnormality occurrence determining section, when the engine rotational speed is greater than or equal to a predetermined rotational speed, determines that there has occurred an abnormality.

4. The controller as set forth in claim 2, wherein the other request is generated only while the internal combustion engine is stopped, the predetermined information represents an injected fuel quantity, and the abnormality occurrence determining section, when the injected fuel quantity is not zero, determines that there has occurred an abnormality.

5. The controller as set forth in claim 2, wherein there are designated two or more secondary request values corresponding respectively to two or more other requests, signals that represent the secondary request values contain priority information in accordance with which a selection is made, the target opening degree calculating section selects any one of the primary request value and the secondary request values in accordance with the priority information.

6. The controller as set forth in claim 5, wherein the abnormality occurrence determining section, when the target opening degree calculating section has selected one of the secondary request values, determines whether or not there has occurred an abnormality in one of the secondary request values that has a top priority.

* * * * *